US006752553B2

(12) United States Patent
Fujioka

(10) Patent No.: US 6,752,553 B2
(45) Date of Patent: Jun. 22, 2004

(54) RECORDING APPARATUS

(75) Inventor: Satoshi Fujioka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/028,995

(22) Filed: Dec. 28, 2001

(65) Prior Publication Data

US 2002/0090245 A1 Jul. 11, 2002

(30) Foreign Application Priority Data

Dec. 28, 2000 (JP) ..... P2000-404660
Jan. 17, 2001 (JP) ..... P2001-009527
Dec. 12, 2001 (JP) ..... P2001-378132

(51) Int. Cl.[7] ..... B41J 13/10
(52) U.S. Cl. ..... 400/642; 400/645; 347/104; 271/188
(58) Field of Search ..... 400/642, 645, 400/578; 347/101–105; 271/19, 20, 90–103, 188, 282–284

(56) References Cited

U.S. PATENT DOCUMENTS 5,092,696 A * 3/1992 Armiroli et al. ..... 400/611
5,124,728 A * 6/1992 Denda ..... 346/134
5,805,176 A * 9/1998 Saito et al. ..... 347/8
5,820,283 A * 10/1998 Sunada et al. ..... 400/642
6,038,776 A * 3/2000 Yamada et al. ..... 33/18.1
6,270,215 B1 * 8/2001 Miyasaka et al. ..... 347/104
6,293,670 B1 * 9/2001 Taniguro et al. ..... 347/104
6,386,536 B1 * 5/2002 Juan ..... 271/276

FOREIGN PATENT DOCUMENTS

EP 0 611 719 A1 8/1994
EP 0 676 296 A1 10/1995
EP 0 927 640 A2 7/1999
EP 0 982 254 A2 3/2000
JP 8-217314 8/1996
JP 8-290566 11/1996
JP 11268857 A * 10/1999 ..... B65H/29/70
JP 11301880 A * 11/1999 ..... B65H/5/36

OTHER PUBLICATIONS

Patent Abstract of Japan, 08–290566, May 11, 1996.
Patent Abstract of Japan, 08–217314, Aug. 27, 1996.
Patent Abstract of Japan, 11–268857, Oct. 5, 1999.
Japanese Abstract No. 11138769, dated May 25, 1999.

* cited by examiner

*Primary Examiner*—Minh H Chau
(74) *Attorney, Agent, or Firm*—Sughrue Mion, PLLC

(57) ABSTRACT

A recording apparatus has a feeding unit for storing and feeding a recording medium, a recording unit for recording information on the recording medium having been fed from the feeding unit, and a discharging unit for discharging outside the recording medium having been transported through the recording unit. In the recording apparatus, a warping part for warping the recording medium and supporting parts for supporting both side edges of the recording medium warped by the warping part are formed on a guide member disposed downstream of the recording unit.

19 Claims, 16 Drawing Sheets

RECORDING APPARATUS

BACKGROUND OF THE INVENTION

The present invention relates to a recording apparatus for recording information in a recording medium, and more particularly to a recording apparatus of which the recording medium transporting unit is contrived.

A conventional large printer as a recording apparatus is made up of a sheet supply unit for supplying a rolled sheet as a recording medium, a printing unit for recording information on the supplied rolled sheet, and a sheet discharge unit for discharging the printed rolled sheet, and those units are disposed in this order from the upper part. To use such a large printer as a large ink jet printer, the user pulls out the leading end of the rolled sheet that is contained in the sheet supply unit. The user moves the leading end of the rolled sheet on and along a flat, sheet feeding guide serving as a sheet transporting surface, puts it between a sheet feeding roller and a follower roller, and starts the printer.

The ink jet printer ejects ink drops from the nozzle orifices of a printing head to record information on the rolled sheet, while feeding the rolled sheet onto the platen by rotating the sheet feeding roller. Then, the printer rotates a sheet discharging roller to discharge outside the rolled sheet on and along a flat, sheet discharging guide serving as a sheet transporting surface.

In the printer, it is a common practice to use for the recording medium, rolled sheets in which fibers are extended in a sheet transporting direction, namely, the sub-scan direction, and which are arranged side by side in a direction perpendicular to the sheet transporting direction, i.e., the main scan direction. At the completion of the printing on the rolled sheet, the rolled sheet is in a water-absorbing state since ink has been attached thereto. In this state, the rolled sheet is made wavy, so-called cockling, in a direction in which the binding of fibers is weak, namely, the main scan direction.

In the conventional printer, the sheet transporting surface ranging from the platen to the sheet discharging guide is flat. Therefore, when the cockling grows, there is a fear that the recording surface of the rolled sheet is rubbed by the printing head located above the platen.

As shown in FIG. 22A, the cockling may be depicted by traces which slope down toward an incomplete printing portion (hatched area in FIG. 22A) of the rolled sheet R of which the printing is not yet completed at the side edges of the rolled sheet near that portion of the rolled sheet. As shown, the ridge lines and the root lines of the cockling converge toward the incomplete printing portion of the rolled sheet at the side edges of the rolled sheet R. As a result, as shown in FIG. 22B, the rolled sheet rises in the vicinity of the incomplete printing portion to possibly rub against the printing head.

SUMMARY OF THE INVENTION

Accordingly, an object of the present invention is to provide a recording apparatus which is capable of preventing the cockling from occurring in the recording medium.

(1) According to the invention, there is provided a first recording apparatus having a feeding unit for storing and feeding a recording medium, a recording unit for recording information on the recording medium having been fed from the feeding unit, and a discharging unit for discharging outside the recording medium having been transported through the recording unit, the improvement being characterized in that a warping part for warping the recording medium is formed on a guide member which is disposed downstream of the recording unit and inclined in a gravity direction.

With such an arrangement, even if the cockling occurs in a recording medium of which the recording has been completed in the recording unit, the recording medium may be bent in a direction orthogonal to directions in which the cockling occurs. Accordingly, stress acting to spread the recording medium in directions of the cockling generation is generated at the bending part. As a result, there is completely eliminated a chance of generating the cockling in the recording medium.

(2) In the recording apparatus according to (1), the warping part includes a flat surface which is uniform over a direction orthogonal to the transporting direction of the recording medium. With this technical feature, the recording medium may be transported on and along the warping part in flat state, whereby preventing the re-occurrence of the cockling.

(3) In the recording apparatus according to (1) or (2), a suction unit for sucking the recording medium is disposed near the warping part. With this feature, the recording medium warped by the warping part is easy to come in contact with the suction unit. As a result, the suction performance of the recording medium is improved.

(4) In the recording apparatus according to any of (1) through (3), a recording medium discharge roller for discharging the recording medium is disposed immediately after the warping part. This feature enables the recording medium of which the cockling is completely removed to be smoothly discharged outside.

(5) In the recording apparatus according to any of (1) through (4), the warping part includes an inclined recording medium transporting surface for changing a transporting direction of the incoming recording medium to warp the recording medium. With this feature, the recording medium may be transported along the flat surface and then the inclined surface. Accordingly, the recording medium is easily warped.

(6) According to another aspect of the invention, there is provided a second recording apparatus having a feeding unit for storing and a feeding recording medium, a recording unit for recording information on the recording medium having been fed from the feeding unit, and a discharging unit for discharging outside the recording medium having been transported through the recording unit, the improvement being characterized in that a warping part for warping the recording medium and supporting parts for supporting both side edges of the recording medium warped by the warping part are formed on a guide member disposed downstream of the recording unit.

With such an arrangement, even if the cockling occurs in a recording medium of which the recording has been completed in the recording unit, the recording medium may be bent in a direction orthogonal to directions in which the cockling occurs. Accordingly, stress acting to spread the recording medium in directions of the cockling generation is generated at the bending part. As a result, there is completely eliminated a chance of generating the cockling in the recording medium. Further, both side ends of the boundary region between a not yet recorded portion suffering from the cockling and a recorded portion are lifted by the supporting parts. The recording medium sags at a part of the recording medium between the supporting parts by its weight, and is concavely curved. Accordingly, there is no chance that the recording medium rises in the boundary region of the recording medium.

(7) In the recording apparatus according to (6), the warping part includes an inclined, recording medium transporting surface for changing a transporting direction of the incoming recording medium to warp the recording medium, and the supporting parts have support surfaces which are flush with the recording medium transporting surface. With this feature, the recording medium may be transported along the flat surface and then the inclined surface. Accordingly, the recording medium is easily warped. Further, the recording medium may be smoothly transported from the recording medium transporting surface to the support surfaces. Accordingly, the recording medium may be concavely curved with good reliability.

(8) In the recording apparatus according to (6) or (7), a plurality of the supporting parts are arranged such that a length of the arrangement of the supporting parts is somewhat narrower than each of the recording mediums of the different widths. Therefore, even if the recording medium is changed to another kind of recording medium, both side edges of the recording medium can be supported with good reliability.

(9) In the recording apparatus according to (7) or (8), an auxiliary supporting part for supporting both side edges of the recording medium is provided on the recording medium transporting surface. With such the arrangement of an auxiliary supporting part, even when the recording medium having a large rigidity is used and is not concavely curved between the supporting parts, the recording medium may be convexly curved by the auxiliary supporting part. As a result, the recording medium may be concavely curved between the auxiliary supporting part and the supporting parts.

(10) In the recording apparatus according to any of (5), (7), (8) and (9), the inclined recording medium transporting surface of the warping part is formed by bending a plate like member in a direction orthogonal to the medium transporting direction. This feature provides the warping part having a simple structure, and hence a simple manufacturing process of manufacturing the recording apparatus.

(11) In the recording apparatus according to any of (1) through (10), the warping part is warped so that the recording surface of the recording medium is concavely curved. Therefore, the recording medium suffering from the cockling may be pressed against the recording medium transporting surface, to thereby perfectly preventing the rubbing of the recording medium against the recording head.

(12) In the recording apparatus according to (11), an inclination angle of the inclined, recording medium transporting surface of the warping part is 6°. If the inclination angle is so selected, no crease is formed in the recording medium, and the formation of the cockling in the recording medium is completely removed.

(13) In the recording apparatus according to (1), the warping part includes a first sheet transporting surface ascendingly inclined and a second sheet transporting surface descendingly inclined with respect to the sheet transporting path of the recording medium.

DETAILED DESCRIPTION OF THE PREFERRED EMBODIMENTS

The preferred embodiments of the present invention will be described in detail with reference to the accompanying drawings.

Figure 1:
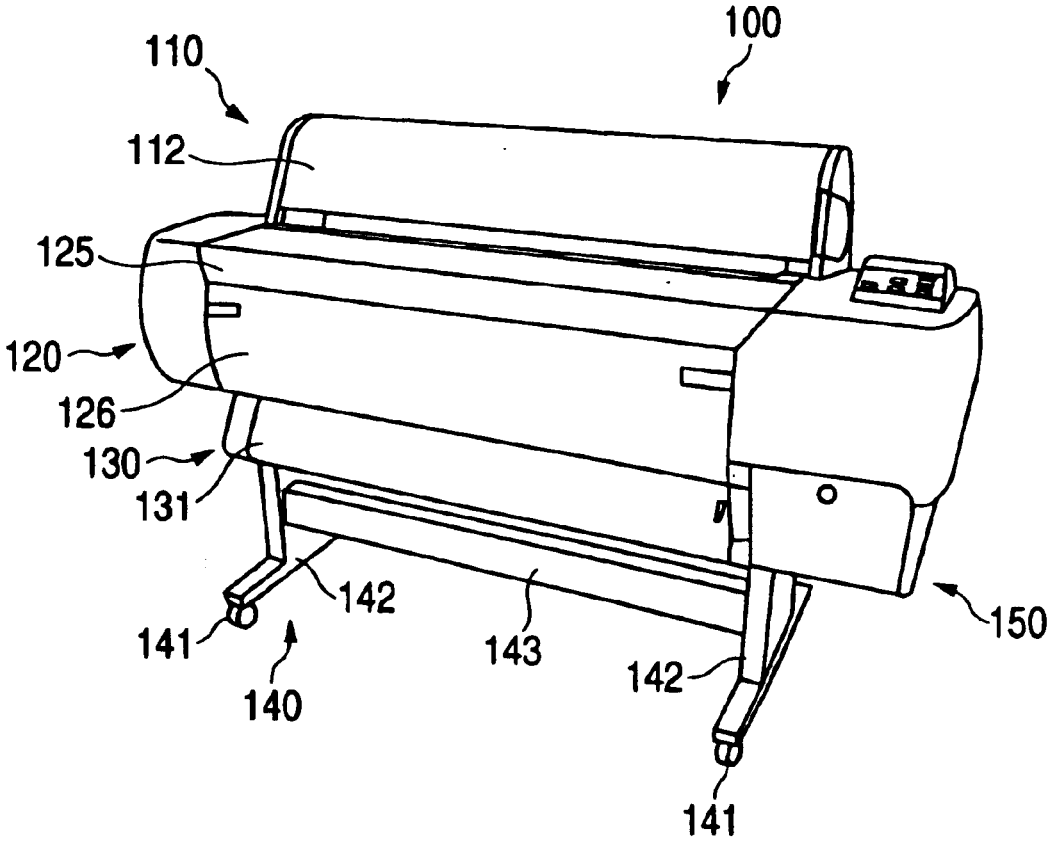
FIG. 1 is a perspective view showing a printer according to an embodiment of the present invention.
Figure 2:
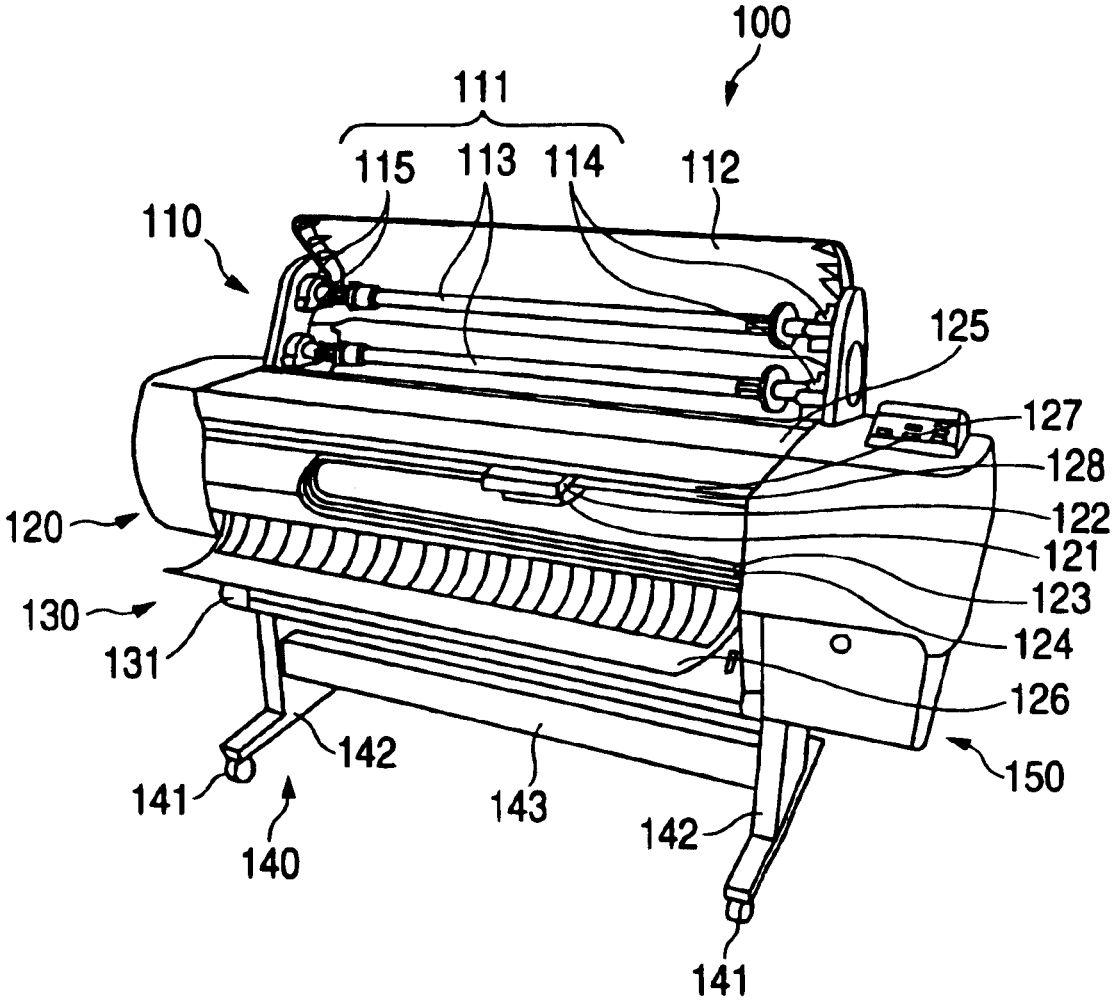
FIG. 2 is a perspective view showing the inner structure of the FIG. 1 printer.

FIG. 1 is a perspective view showing an ink jet printer as one form of a recording apparatus, which is an embodiment of the invention. FIG. 2 is a perspective view showing the inner structure of a key portion of the ink jet printer. An ink jet printer 100 shown in FIGS. 1 and 2 is a large printer which is capable of printing on a print sheet of relatively large size, such as A1 or B1 size in JIS standard. The ink jet printer is made up of a sheet supply unit 110, a printing unit 120, a sheet discharge unit 130 and leg means 140, and those units and part are disposed in this order. The printing unit 120 and the sheet discharge unit 130 are assembled into a main body, and the sheet supply unit 110 and the leg means 140 are separable from the main body.

The sheet supply unit 110 is provided such that it projects backwardly from the upper part of the main body 120 and 130, as shown in FIG. 1. As shown in FIG. 2, two rolled sheet holders 111, arranged in vertical direction while being aslant, are provided within the sheet supply unit 110. Those holders allow rolled sheets to be set thereon, respectively. A rolled sheet cover 112 of the flip-up type, which may be turned for opening and closing, as shown in FIGS. 1 and 2, is mounted on the front surface of the sheet supply unit 110 in a state that it covers the rolled sheet holders 111.

Each rolled sheet holder 111, as shown in FIG. 2, includes a spindle 113 for holding a rolled sheet, and a couple of spindle receivers 114 and 115 which are mounted in both the side walls of the sheet supply unit 110. The spindle 113 is detachably set to those spindle receivers such that it is bridged between them. To set the spindle 113 to the spindle receivers 114 and 115, a rolled sheet is applied to a a middle part of the spindle 113, and both ends of the spindle are rotatably put in the spindle receivers 114 and 115. As shown in FIGS. 1 and 2, the rolled sheet cover 112 is rotatably supported at the upper part, and may be opened by lifting the lower part of the cover, and closed by pushing it down.

The printing unit 120, as shown in FIG. 2, is provided with a carriage 122 on which a printing head 121 mounted, a flexible flat cable (referred to as an FFC) 123 interconnecting the printing head 121 and a control unit (not shown) for executing the printing, an ink tube 124 interconnecting the printing head 121 and an ink cartridge (not shown) containing ink, a sheet feeding roller (not shown) for feeding a rolled sheet in the sub-scan direction, and a sheet suction means (not shown) preventing the rolled sheet from rising. An upper cover 125 and a front cover 126, as shown in FIGS. 1 and 2, are respectively mounted on the upper part and the front part of the printing unit 120, and cover the printing head 121, the carriage 122 and the like.

The printing head 121 includes a printing head for ejecting black ink and a plurality of color printing heads for ejecting such color inks as yellow, light cyan, cyan, light magenta, magenta inks and the like. The printing head 121 includes pressure generating chambers and nozzle orifices connecting to the former. When ink is stored in each pressure generating chamber and the pressure generating chamber is pressurized by a predetermined pressure, the printing head 121 ejects an ink drop of the controlled size from the nozzle orifice toward the rolled sheet.

The carriage 122, as shown in FIG. 2, is suspended from a rail 127 which is extended in the main scan direction, by the roller, and is coupled to a carriage belt 128. When the carriage belt 128 is turned by a carriage driver (not shown), the carriage is reciprocatively moved while being guided along the rail 127, with the movement of the carriage belt 128.

The FFC 123 is connected at one end to a connector of the control unit, and at the other end to the connector of the printing head 121. The FFC thus connected transmits a print signal from the control unit to the printing head 121. The ink tubes 124 are provided and laid for the respective color inks. Those ink tubes are connected at first ends to the color ink cartridges by way of ink pressure supplying means, and at the second ends to the color printing heads 121.

The ink tubes 124 supply the respective color inks as pressurized by the ink pressurize-supplying means, from the ink cartridges to the printing heads 121, respectively. As shown in FIGS. 1 and 2, the front cover 126 is rotatably supported at the lower part, and may be opened by lifting the upper part of the cover, and closed by pushing it down.

As shown in FIGS. 1 and 2, the sheet discharge unit 130 includes a sheet discharging guide 131 which forms a part of a path for transporting a rolled sheet in the sub-scan direction, and a sheet discharge roller (not shown), which transports a rolled sheet in the sub-scan direction. A cartridge holder 150 for containing and holding ink cartridges is provided at a right-side location as viewed from the front side of the sheet discharge unit 130, as shown in FIGS. 1 and 2.

The leg means 140 include two supports 142 with rollers 141 for apparatus movement, and a reinforcing bar 143 bridged between those supports 142, as shown in FIGS. 1 and 2. The sheet supply unit 110 and the main body 120 and 130 are placed on the supports 142 and fastened to the latter by means of screws.

Figure 3:
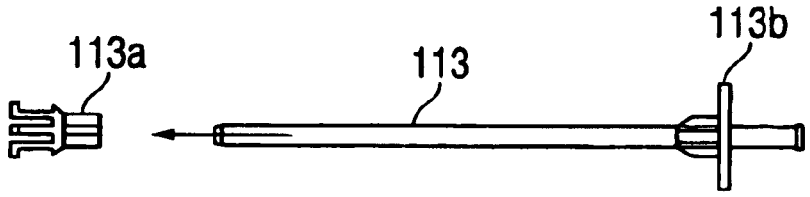
FIG. 3 is a first diagram showing a procedure to use the FIG. 1 printer.

With such a mechanical arrangement, to use the ink jet printer 100, the spindle 113 forming the rolled sheet holder 111 is first removed from the sheet supply unit 110. A rolled sheet holder 113*a* inserted in the spindle 113 is pulled off from one end of the spindle 113, as shown in FIG. 3.

Figure 4:
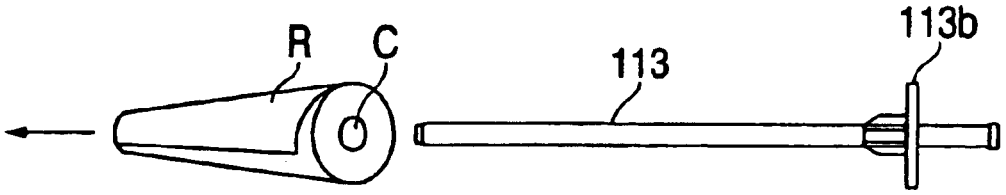
FIG. 4 is a second diagram showing a procedure to use the FIG. 1 printer.
Figure 5:
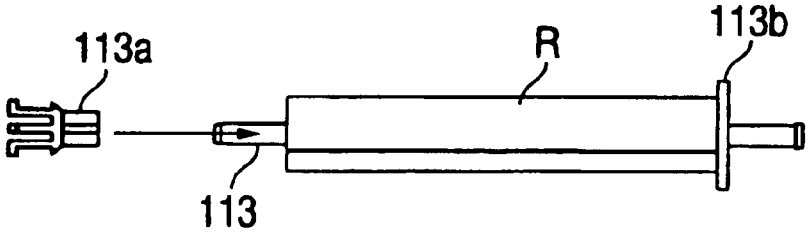
FIG. 5 is a third diagram showing a procedure to use the FIG. 1 printer.

As shown in FIG. 4, one end of the spindle 113 is inserted into one end of a shaft hole C of the rolled sheet R, and the spindle is passed therethrough. As shown in FIG. 5, one end of the shaft hole C of the rolled sheet R is fit to a rolled sheet holder 113*b*, which is applied and fixed to the other end of the spindle 113. Subsequently, the rolled sheet holder 113*a* is applied to the one end of the spindle 113, and is fitted into the other end of the shaft hole C of the rolled sheet R. As a result, the rolled sheet R is rotatable together with the spindle 113.

Figure 6:
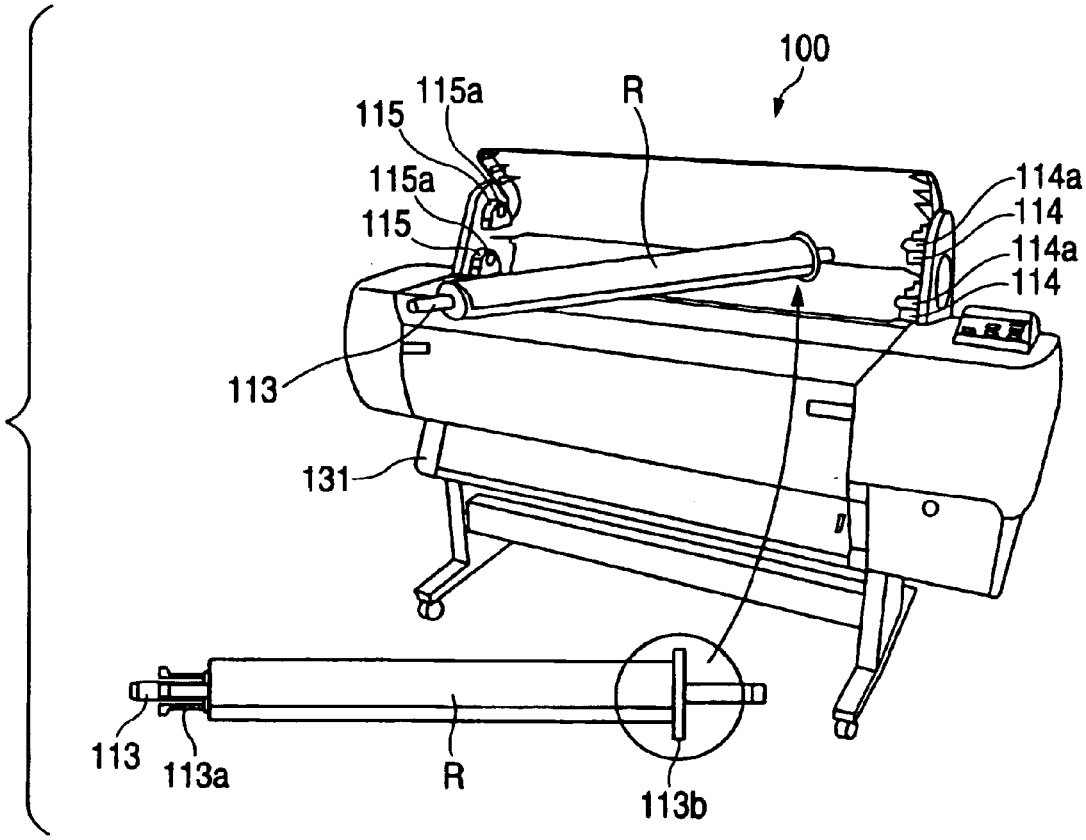
FIG. 6 is a fourth diagram showing a procedure to use the FIG. 1 printer.
Figure 7:
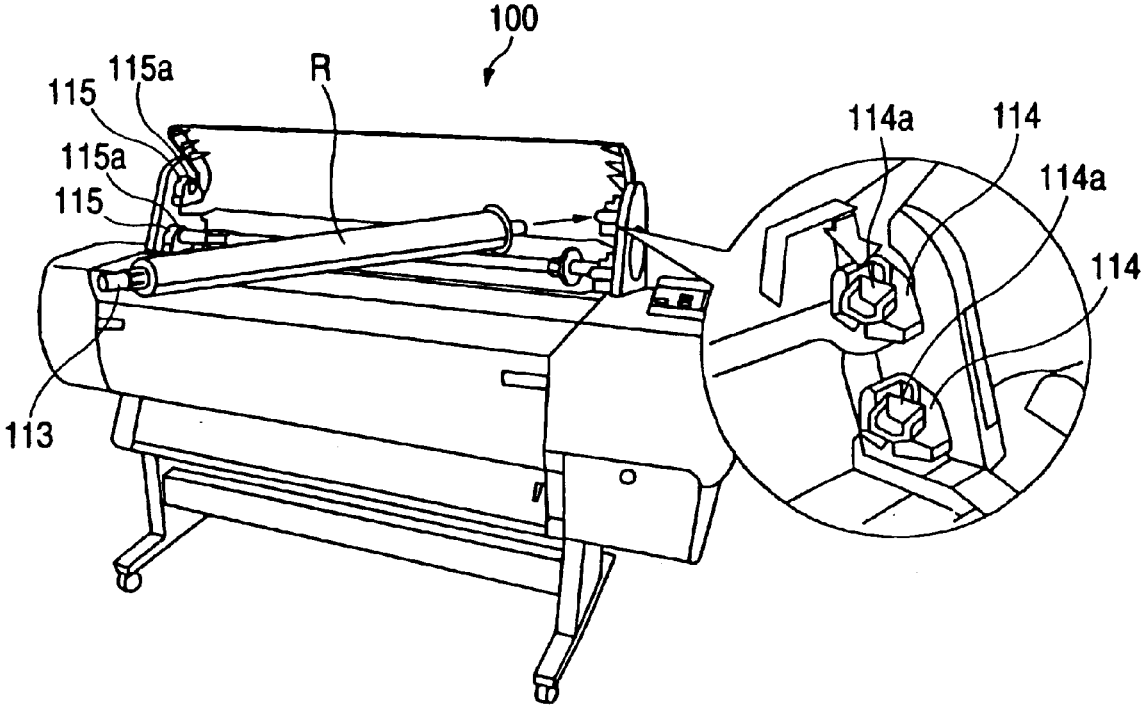
FIG. 7 is a third diagram showing a procedure to use the FIG. 1 printer.

Then, as shown in FIG. 6, the user holds both ends of the rolled sheet R loaded spindle 113 with his hands, and puts it obliquely with respective to the cross direction of the ink jet printer 100, viz., puts it in a state that the other end of the rolled sheet R loaded spindle 113 is directed to the spindle receiver 114.

The spindle receiver 114 may be turned in the horizontal direction. Usually, recesses 114*a* and 115*a* of the spindle receivers 114 and 115 for receiving the ends of the spindle 113, are opposed to each other. When the spindle 113 having the rolled sheet R loaded thereto is set to the printer, the spindle receiver 114 is turned to have an angle of about 45° with respective to the spindle receiver 115.

Thereafter, the other end of the spindle 113 having the rolled sheet R loaded thereto is put on the recess 114*a*, and in this state, the spindle receiver 114 is turned together with the spindle 113 on which the rolled sheet R is loaded. The recesses 114*a* and 115*a* of the spindle receivers 114 and 115 are opposed to each other, and then the one end of the spindle 113 on which the rolled sheet R is loaded is put on the recess 115*a* of the spindle receiver 115. In this way, the spindle 113 on which the rolled sheet R is loaded may be easily attached to the sheet supply unit 110.

Figure 8:
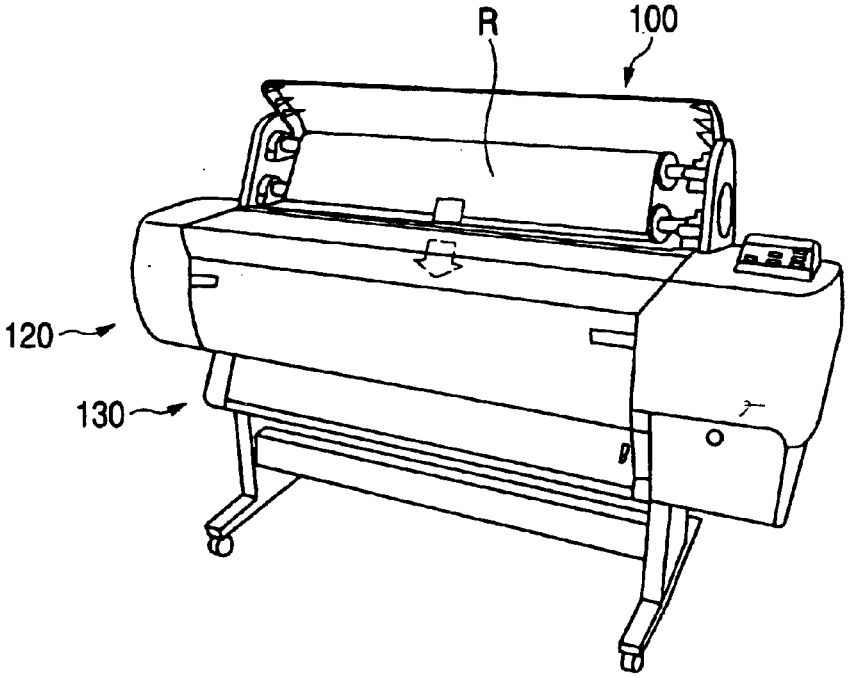
FIG. 8 is a sixth diagram showing a procedure to use the FIG. 1 printer.
Figure 9:
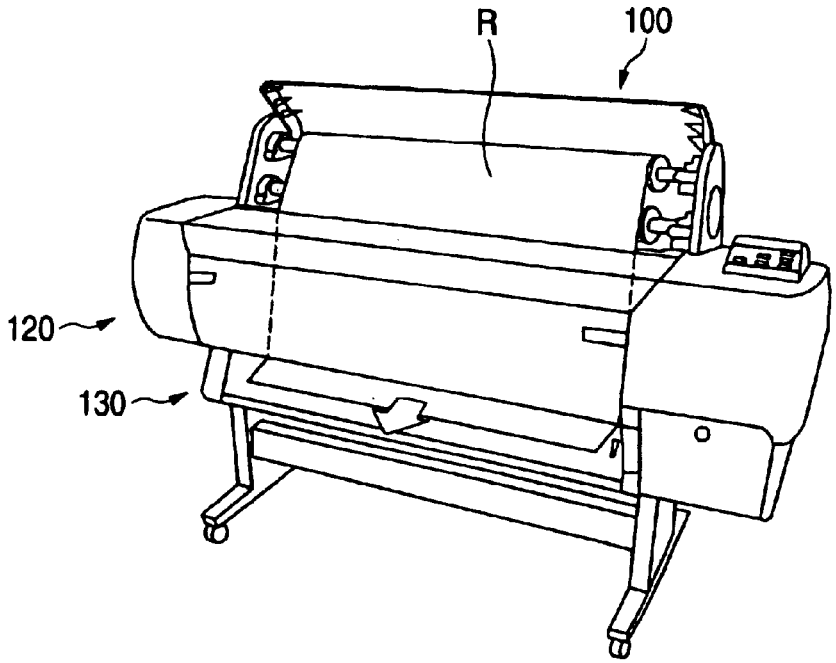
FIG. 9 is a seventh diagram showing a procedure to use the FIG. 1 printer.
Figure 10:
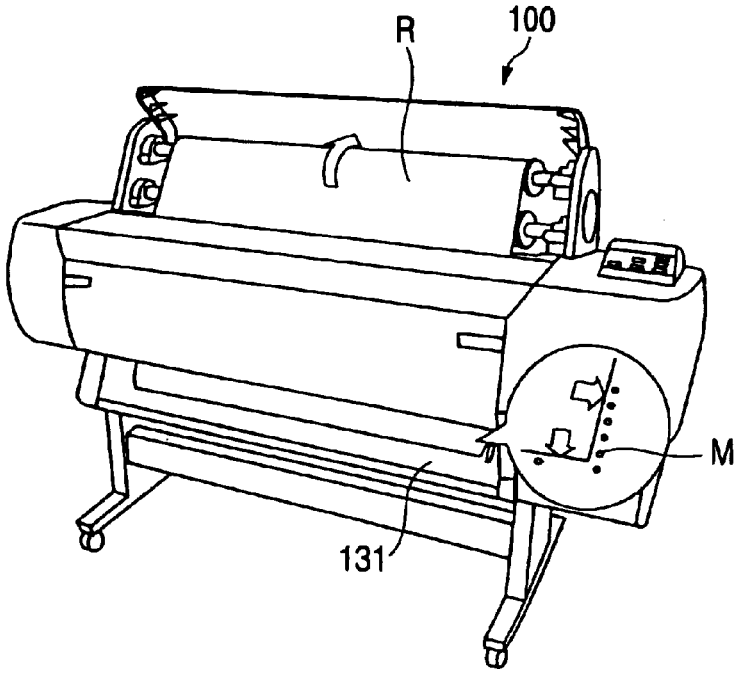
FIG. 10 is an eighth diagram showing a procedure to use the FIG. 1 printer.

The leading end of the rolled sheet R, as shown in FIG. 8, is pulled down, and moved along the transporting path of the printing unit 120 and further to the transporting path of the sheet discharge unit 130 as shown in FIG. 9. The rolled sheet R, as shown in FIG. 10, is rolled back, and the leading end of the rolled sheet R is set at markers M of the sheet discharging guide 131. Then, the ink jet printer 100 is started, and ejects ink drops while feeding the rolled sheet R in the sub-scan direction and moving the printing head 121 in the maim scan direction. It records given information on the rolled sheet R and discharges the resultant.

Figure 11:
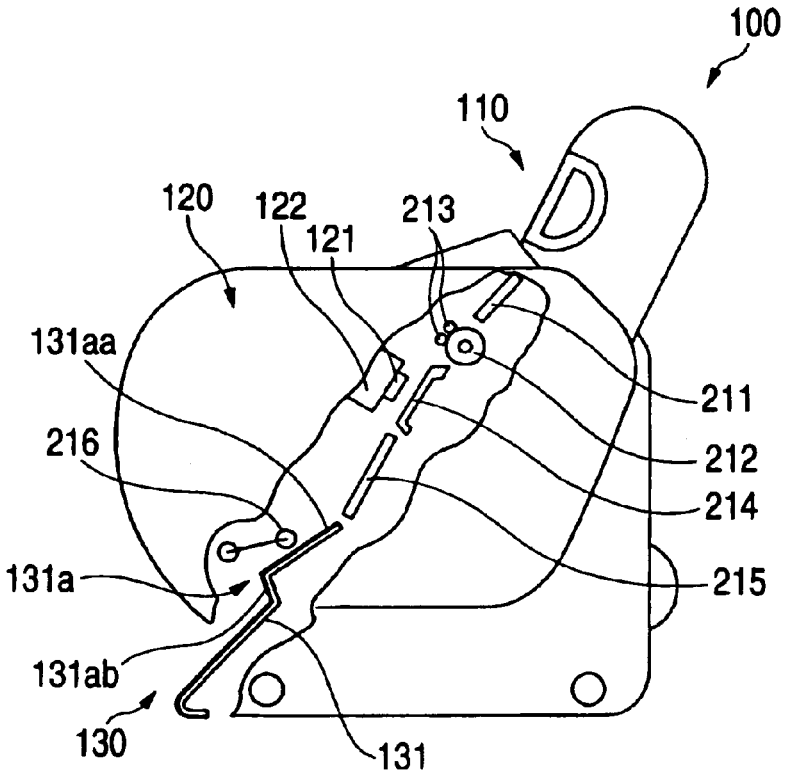
FIG. 11 is a side view, partly broken, showing a sheet transporting surface of a recording medium, which is essential to the present invention.

FIG. 11 is a side view, partly broken, showing a sheet transporting surface of a recording medium, which is essential to the present invention. A sheet transporting path, which is extended from the sheet supply unit 110 through the printing unit 120 to the sheet discharge unit 130, is inclined over a range from the upper rear side to the lower front side of the ink jet printer 100.

The sheet transporting path includes a flat, sheet feeding guide 211 disposed ranging from the sheet supply unit 110 and the printing unit 120, a sheet feeding roller 212 and a follower roller 213 which are oppositely disposed and may come in contact with each other and may be separated from each other, a flat platen 214 disposed in opposition to the printing head 121 mounted on the carriage 122, a flat sheet suction unit 215 disposed ranging from the printing unit 120 to the sheet discharge unit 130, a sheet discharging guide 131 which is disposed in the sheet discharge unit 130 with its part being projected, and a sheet discharge roller 216 disposed facing the sheet discharging guide 131.

Figure 12:
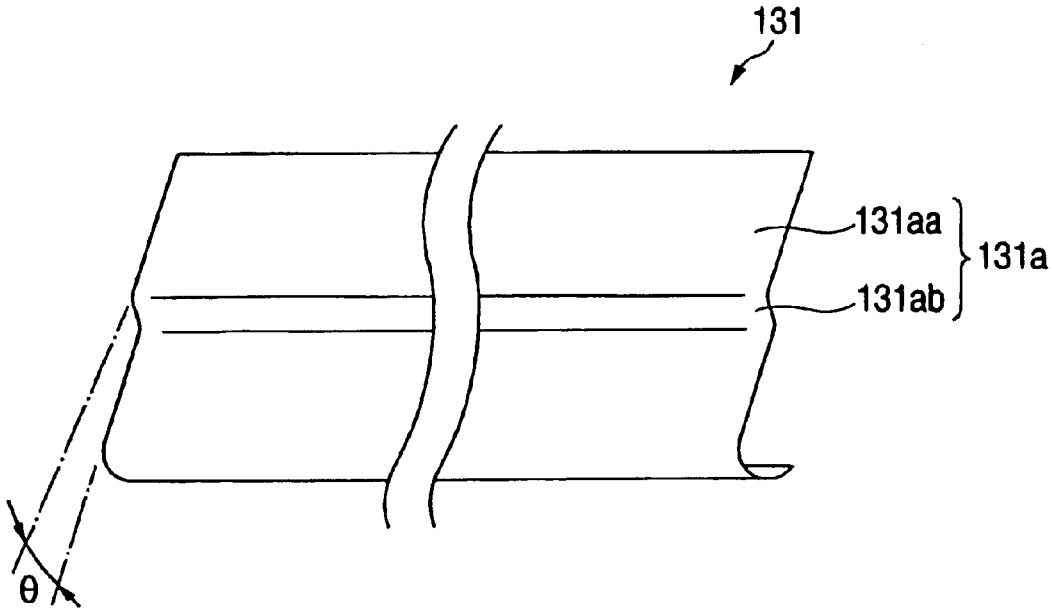
FIG. 12 is a diagram showing the detail of a sheet discharging guide shown in FIG. 11.

The sheet feeding guide 211, the platen 214 and the sheet suction unit 215 serve as sheet transporting surfaces, and are flat in shape. Accordingly, the rolled sheet extending from the sheet feeding guide 211 through the platen 214 to the sheet suction unit 215 is transported in a state that it is flat. The sheet discharging guide 131 also serves as a sheet transporting surface. As shown in FIGS. 11 and 12, the sheet discharging guide 131 includes a warping part 131*a* for warping the incoming rolled sheet.

The sheet discharging guide 131 is formed with a metal plate. The warping part 131*a* is bent such that the transporting surface of the metal plate, which is closer to the printing unit 120, is convexly curved in a direction orthogonal to the rolled sheet transporting direction. Specifically, provided at a location of the sheet discharging guide 131 which is closer to the printing unit 120 is the warping part 131*a* which contains an ascending sheet transporting surface 131*aa* ascendingly inclined with respect to the sheet transporting surface of the sheet suction unit 215, and a decending sheet transporting surface 131*ab* descendingly inclined with the same.

Figure 13A:
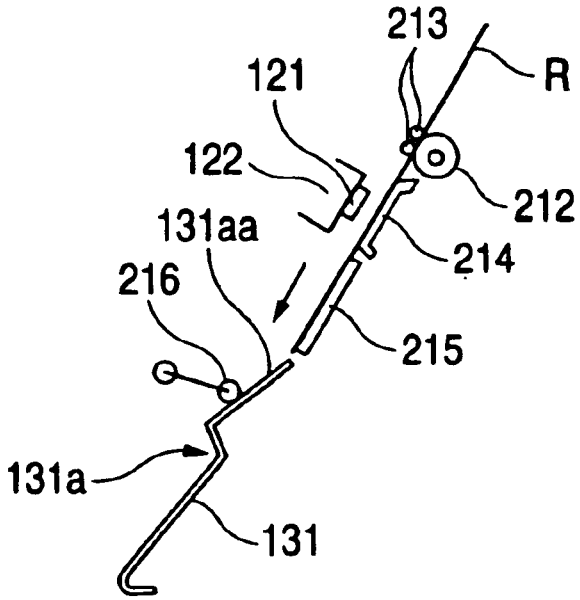
FIGS. 13A and 13B are side views for explaining the operation of a sheet discharging guide shown in FIG. 11.
Figure 13B:
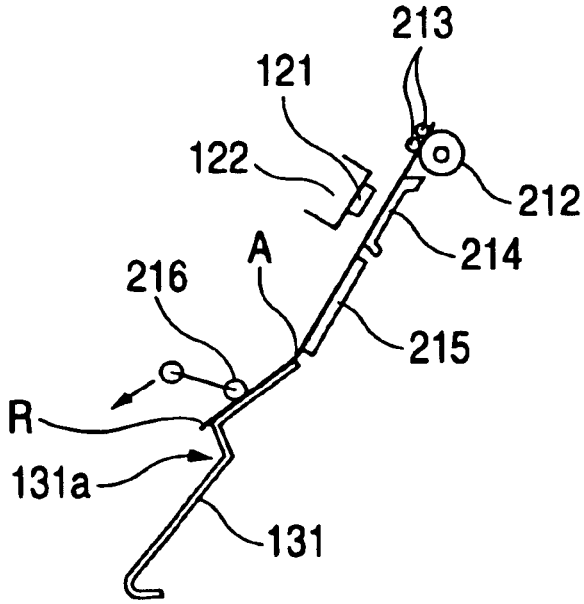

With such a mechanical arrangement, after the leading end of the rolled sheet R passes the sheet suction unit 215 and reaches the sheet discharging guide 131 as shown in FIG. 13A, it is guided along the ascending sheet transporting surface 131*aa* of the warping part 131*a*. Accordingly, the rolled sheet R, as shown in FIG. 13B, is bent at and along a boundary line A between the sheet suction unit 215 and the sheet discharging guide 131, viz., the printing surface of the rolled sheet R is concavely curved.

Thus, the rolled sheet R is bent in a direction orthogonal to the main scan direction by the warping part 131*a*. Accordingly, even if the rolled sheet R of which the printing has been completed in the printing unit 120 is cockled in the main scan direction, stress acting to spread the rolled sheet R in directions of the cockling generation is generated at the bending part. As a result, there is completely eliminated a chance of generating the cockling in the rolled sheet.

The printing surface of the rolled sheet R is warped, by the warping part 131*a*, to be concavely curved. Further, the rolled sheet R is pressed against the ascending sheet transporting surface 131*aa* of the warping part 131*a* by means of the sheet discharge roller 216. Accordingly, the rolled sheet R suffering from the cockling, which is located closer to the sheet suction unit 215, can reliably be pressed against the sheet suction unit 215, to thereby perfectly preventing the rubbing of the rolled sheet R against the printing head 121.

An inclination angle of the ascending sheet transporting surface 131*aa* of the warping part 131*a* was studied. Here the inclination angle is defined as an angle formed between the ascending sheet transporting surface 131*aa* and the flat sheet transporting surface of the sheet suction unit 215. The following fact was found and confirmed. When the inclination angle is set at 6°, no crease is formed in the rolled sheet R along the boundary line A between the sheet suction unit 215 and the sheet discharging guide 131. Accordingly, no cockling occurs. In this respect, in design, it is desirable to select the inclination angle of the ascending sheet transporting surface 131*aa* of the warping part 131*a* to be 6°.

In the embodiment mentioned above, the rolled sheet R is warped so that its printing surface is concavely curved. It is evident that where the rolled sheet R is warped such that the printing surface of the rolled sheet is convexly curved, no cockling occurs in the rolled sheet.

Figure 14:
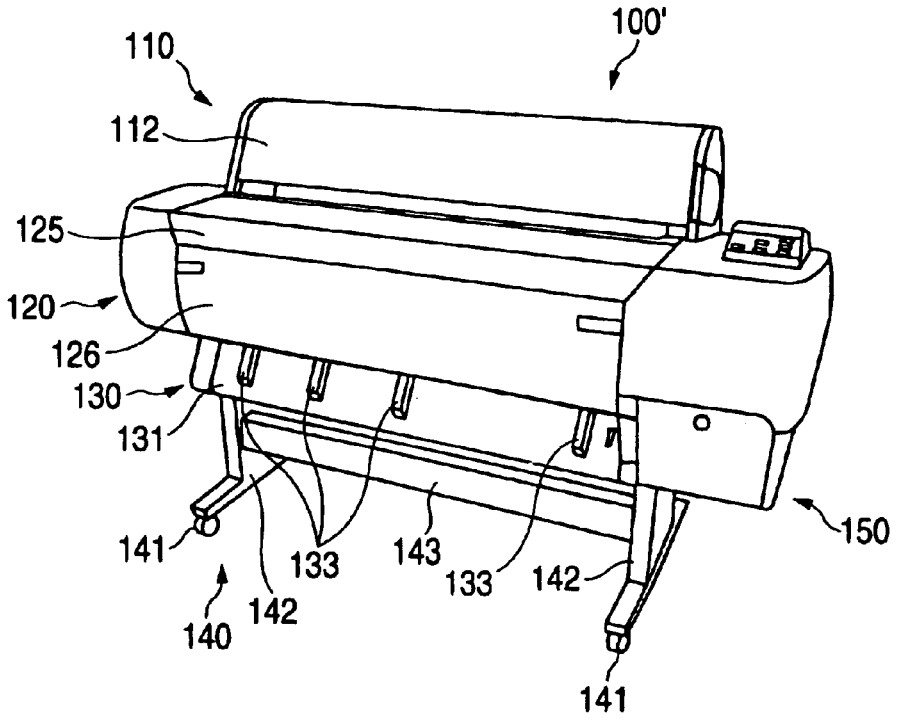
FIG. 14 is a perspective view showing an ink jet printer having another sheet transporting surface of the recording medium, which is essential to the present invention.
Figure 15:
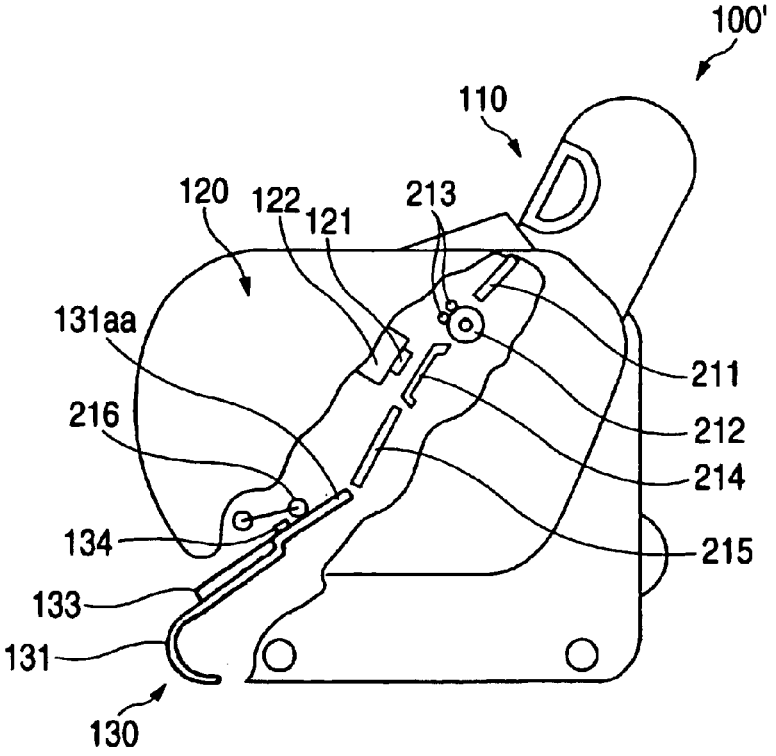
FIG. 15 is a side view, partly broken, showing the sheet transporting surface shown in FIG. 14.
Figure 16:
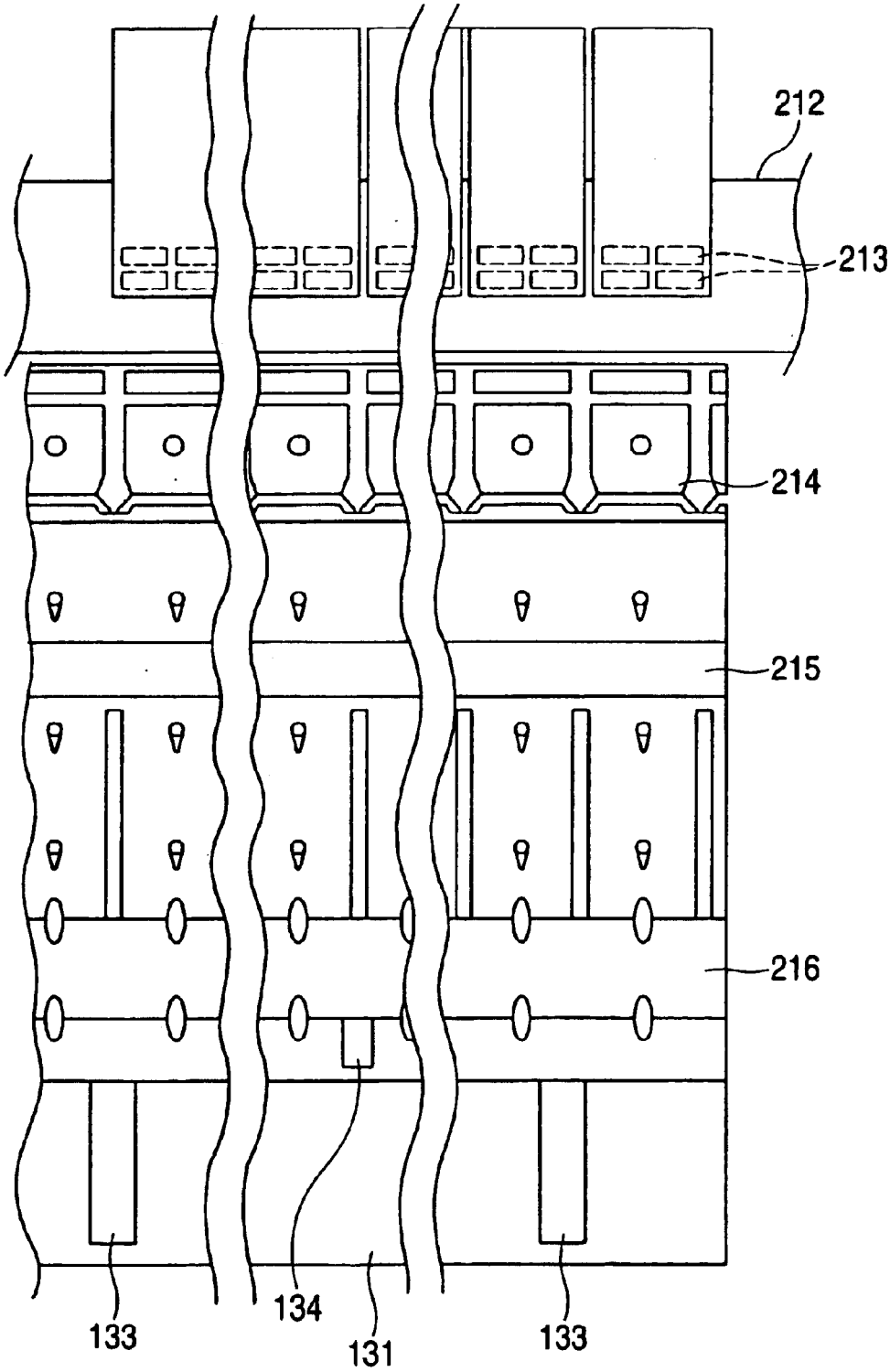
FIG. 16 is a plan view showing a sheet transporting surface shown in FIG. 14.
Figure 17:
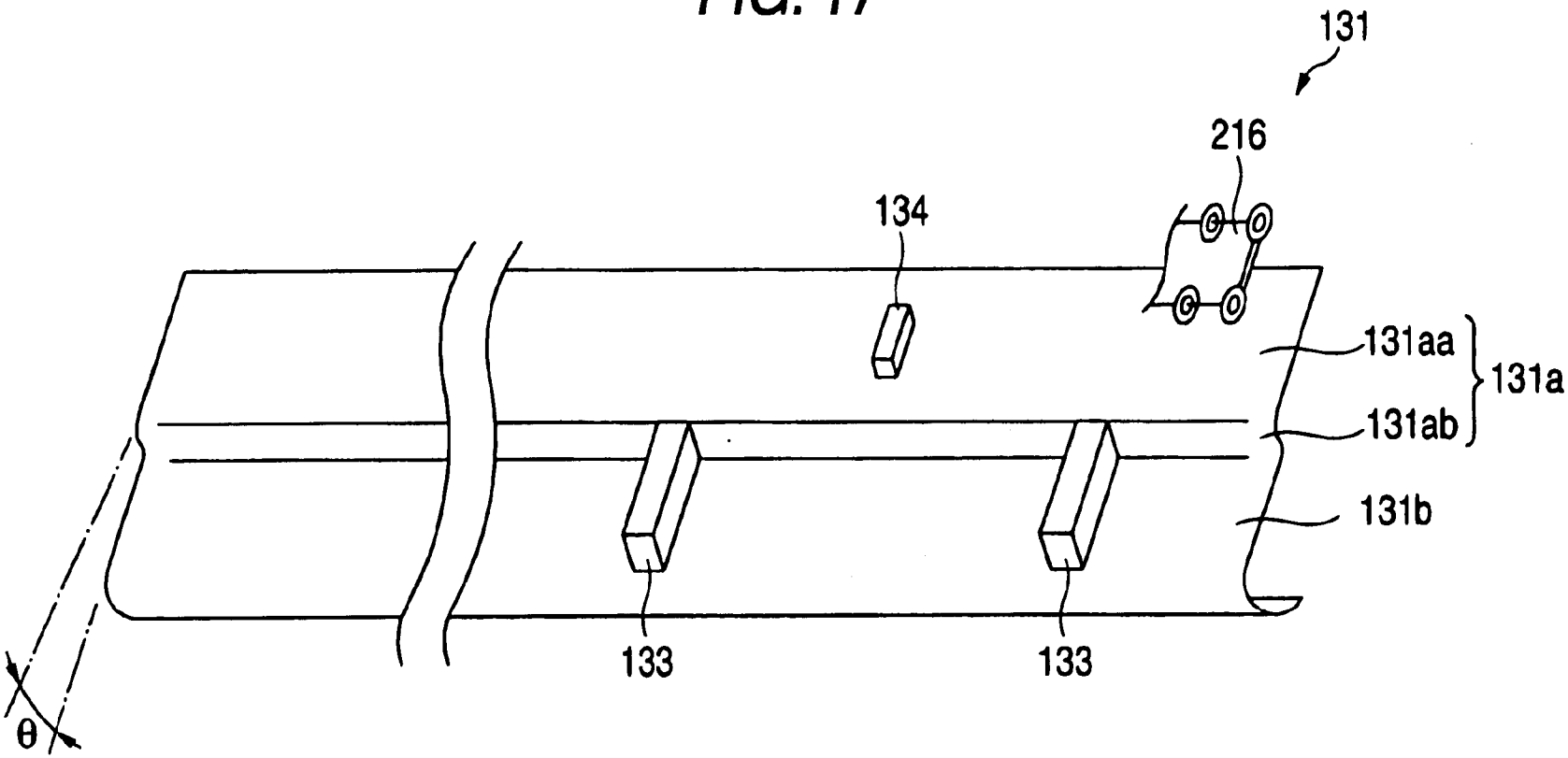
FIG. 17 is a diagram showing the detail of a sheet discharging guide shown in FIG. 15.

FIG. 14 is a perspective view showing, while corresponding to FIG. 1 in the first embodiment, an ink jet printer having another sheet transporting surface of the recording medium, which is essential to the present invention. FIG. 15 is a side view, partly broken, showing the sheet transporting surface, while corresponding to FIG. 11. FIG. 16 is a plan view showing the sheet transporting surface. FIG. 17 is a perspective view showing a sheet discharging guide for the sheet transporting surface, while corresponding to FIG. 12. In those figures, like or equivalent portions are designated by like reference numerals.

Figure 18:
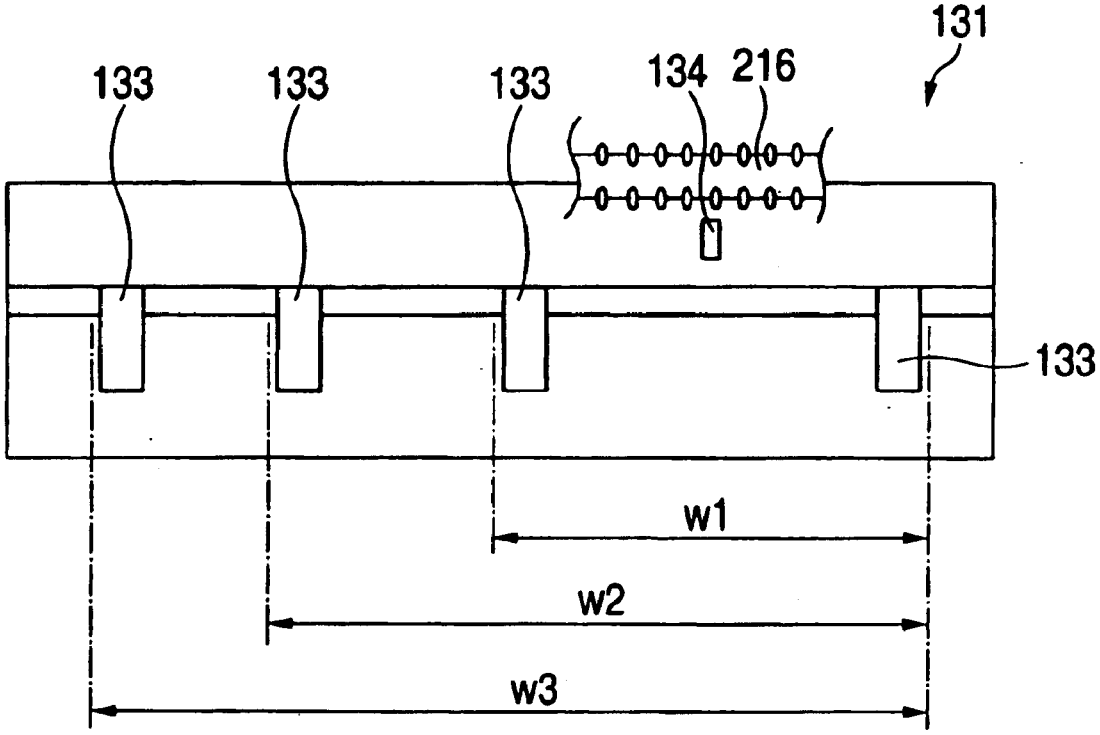
FIG. 18 is a plan view showing the detail of a sheet discharging guide shown in FIG. 15.

As shown in FIGS. 14 through 17, in an ink jet printer 100', supporting parts 133, bar-shaped, for supporting both side edges of the rolled sheet R, are provided on the sheet transporting surface 131*b* of the sheet discharging guide 131, which is located downstream of the descending sheet transporting surface 131*ab*. The upper surfaces of the supporting parts 133 are flush with the ascending sheet transporting surface 131*aa*. A plurality of the supporting parts 133, as illustrated in FIG. 18, are arranged such that a length of the arrangement of the supporting parts 133 is somewhat narrower than each of the widths W1, W2, W3 of the rolled sheets R of different sizes, for example, 24 inches, 36 inches and 44 inches.

Figure 19A:
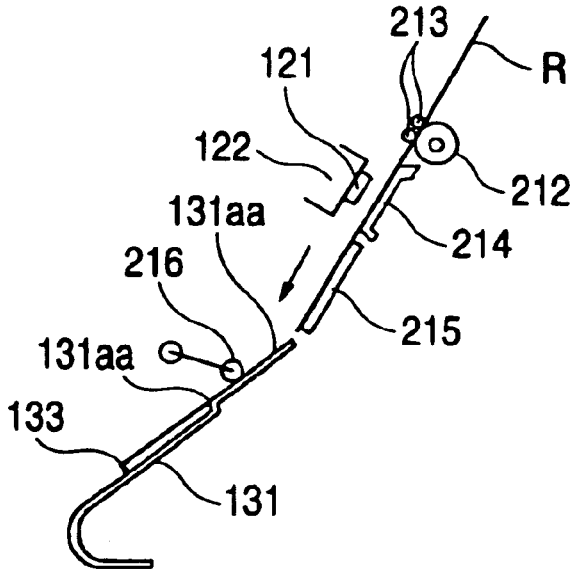
FIGS. 19A and 19B are side views for explaining the operation of a sheet discharging guide shown in FIG. 15.
Figure 19B:
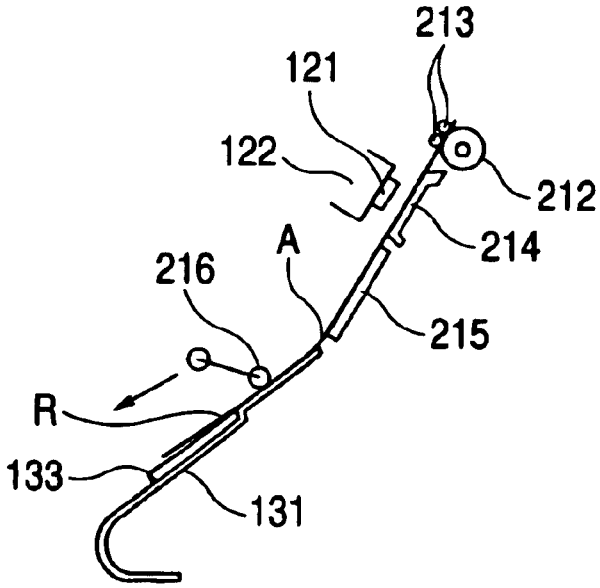

With such the arrangement of the supporting parts 133, as shown in FIG. 19A, the leading end of the rolled sheet R passes the sheet suction unit 215 and reaches the sheet discharging guide 131. Subsequently, as shown in FIG. 19B, it is guided along the ascending sheet transporting surface 131*aa* of the warping part 131*a*, and further to the upper surface of the supporting parts 133.

Figure 20A:
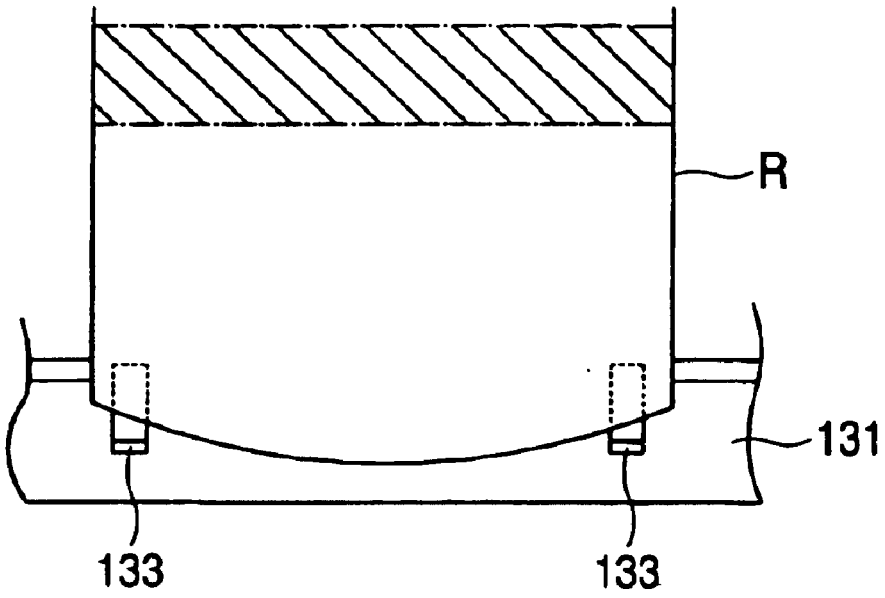
FIGS. 20A and 20B show a plan view and a side view respectively for explaining the operation of a sheet discharging guide shown in FIG. 15.
Figure 20B:
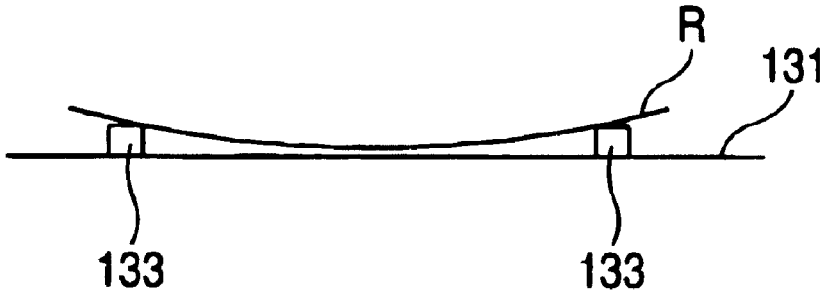

For this reason, even if the ridge lines and the root lines of the cockling converge toward a portion of the rolled sheet R of which the printing is not yet completed, both side ends of the rolled sheet R, as shown in FIGS. 20A and 20B, are lifted by the supporting parts 133, while the rolled sheet R sags at a part of the rolled sheet between the supporting parts 133 by its weight, and is concavely curved. Accordingly, there is no chance that the rolled sheet R rises in the vicinity of the incomplete printing portion of the rolled sheet.

Since the upper surfaces of the supporting parts 133 are flush with the ascending sheet transporting surface 131*aa*, the rolled sheet can be smoothly transported from the ascending sheet transporting surface 131*aa* of the warping part 131*a* to the upper surface of the supporting parts 133, so that the rolled sheet R may be concavely curved reliably. Since the plurality of the supporting parts 133 are arranged such that a length of the arrangement is somewhat narrower than the width of each of the rolled sheets R, even if the rolled sheet R is changed to another kind of rolled sheet, both side edges of the rolled sheet R can be reliably supported.

Figure 21A:
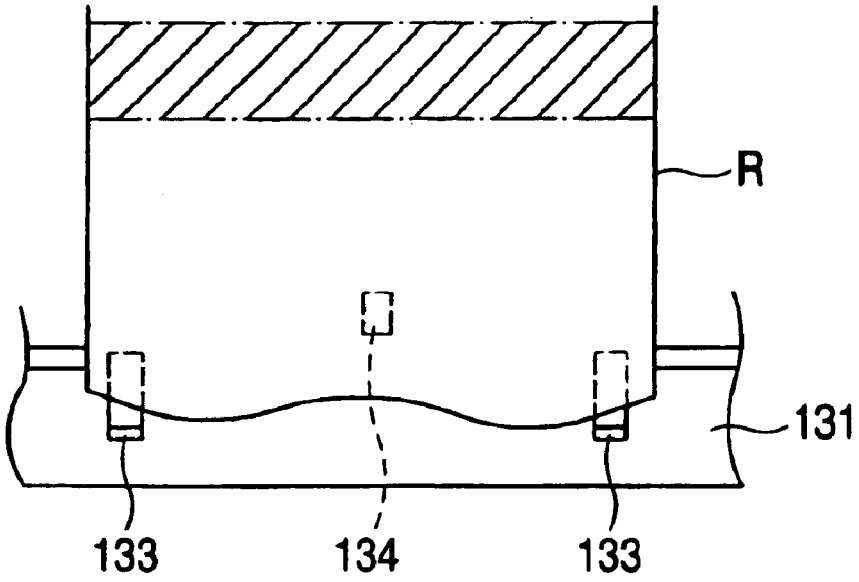
FIG. 21A and FIG. 21B show another plan view and another side view respectively for explaining the operation of a sheet discharging guide shown in FIG. 15.
Figure 21B:
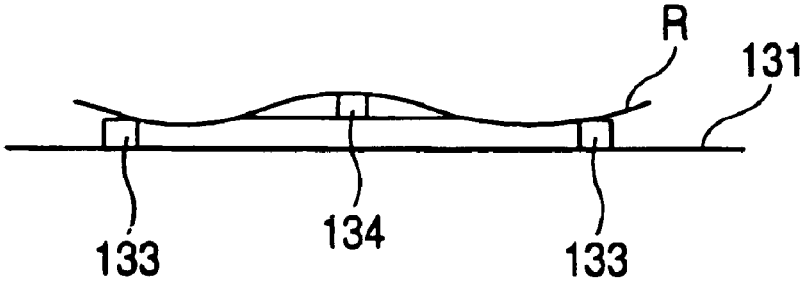
Figure 22A:
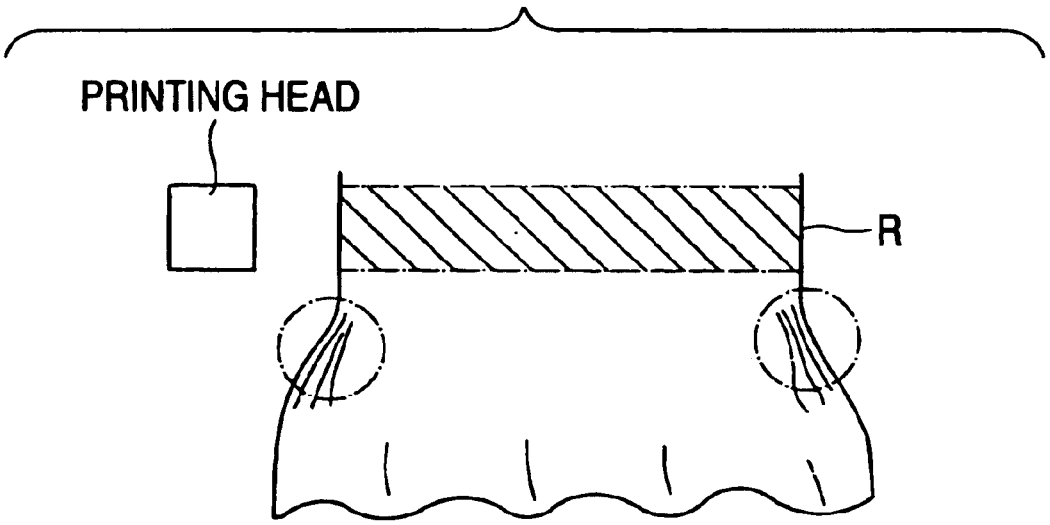
FIGS. 22A and 22B show another plan view and another side view for explaining the problems of the conventional technique.
Figure 22B:
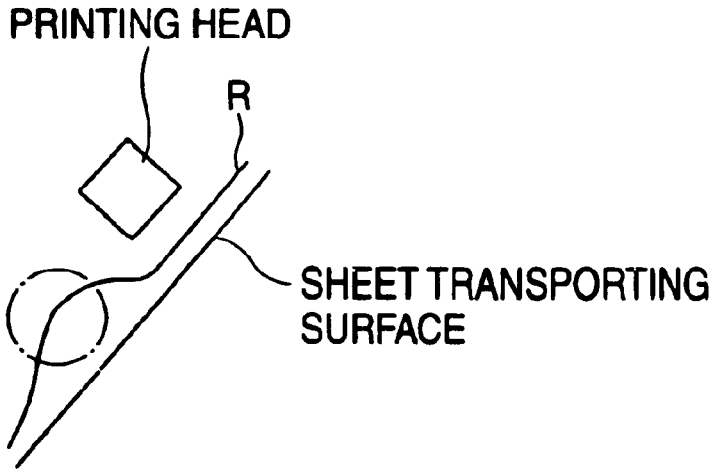

As shown in FIGS. 15 through 18, an auxiliary supporting part 134 bar shaped for supporting a mid position of the rolled sheet R is provided on the descending sheet transporting surface 131*aa* of the sheet discharging guide 131 of the ink jet printer 100'. With such the arrangement of the auxiliary supporting part 134, even when the rolled sheet R having a large rigidity is used and is not concavely curved between the supporting parts 133 the rolled sheet R may be convexly curved by the auxiliary supporting part 134 as shown in FIGS. 21A and 21B. As a result, the rolled sheet may be concavely curved between the auxiliary supporting part 134 and the supporting parts 133. Accordingly, even the rigidity of the rolled sheet R is large, there. is no chance that the rolled sheet R rises in the vicinity of the incomplete printing portion of the rolled sheet.

While the invention has been described using the printer, it will be readily understood that the invention may be applied to another recording apparatus having the transport guide portion for guiding the transportation of the recording medium, such as facsimile machines and copying machines.

As seen from the foregoing description, in the printer of the present invention, even if the cockling occurs in a recording medium of which the printing has been completed in the recording unit, the recording medium is bent in a direction orthogonal to directions in which the cockling occurs, and stress acting to spread the rolled sheet in directions of the cockling generation is generated at the bending part. As a result, there is completely eliminated a chance of generating the cockling in the rolled sheet. Both side ends of the rolled sheet in the boundary region between an incomplete printing portion suffering from the cockling and a printed portion are lifted by the supporting parts. Accordingly, the rolled sheet sags at a part of the rolled sheet between the supporting parts by its weight, and is concavely curved. As a result, the rolled sheet does not rise in the boundary region of the rolled sheet. Accordingly, the rubbing of the rolled sheet against the printing head is perfectly prevented, the printing head is reliably protected, and the accuracy of the printing is kept at high level.

What is claimed is:

1. A recording apparatus comprising:

a feeding unit for storing and feeding a recording medium;

a recording unit for recording information on said recording medium being fed from said feeding unit;

a discharging unit discharging said recording medium transported through said recording unit;

a guide member forming a sheet transporting surface disposed on a downstream side of said recording unit in a transporting direction of said recording medium;

a transport path section which transports said recording medium in said transporting direction and which is disposed between said guide member and said recording unit;

a warping part formed on at least one of said guide member and said transport path section for warping said recording medium; and a discharge roller provided downstream of a warped portion of said recording medium, wherein said guide member is ascendingly inclined with respect to said transport path section, wherein said guide member directs said recording medium downward as said recording medium is transported in said transporting direction.

2. A recording apparatus according to claim 1, wherein said warping part includes a flat surface which is uniform over a direction orthogonal to said medium transporting direction.

3. A recording apparatus according to claim 1, wherein further comprising a sheet suction unit for sucking said recording medium disposed near said warping part.

4. A recording apparatus according to claim 1, wherein said discharge roller for discharging said recording medium is disposed immediately after said warping part.

5. A recording apparatus according to claim 1, wherein part includes an inclined recording medium transporting surface for changing the transporting direction of said recording medium to thereby warp said recording medium.

6. A recording apparatus according to claim 5, wherein said inclined recording medium transporting surface of said warping part is formed by bending a plate like member in a direction orthogonal to said medium transporting direction.

7. A recording apparatus according to claim 1, wherein said warping part is warped so that the printing surface of said recording medium is concavely curved.

8. A recording apparatus according to claim 7, wherein an inclination angle of said inclined recording medium transporting surface of said warping is 6°.

9. A recording apparatus as claimed in claim 1, wherein said guide member and said transport path section are contiguous.

10. A recording apparatus comprising:

a feeding unit for storing and feeding recording medium;

a recording unit for recording information on said recording medium fed from said feeding unit;

a discharging unit for discharging outside said recording medium transported through said recording unit;

a guide member forming a sheet transporting surface disposed on a downstream side of said recording unit in a transporting direction of said recording medium;

a transport path section which transports said recording medium in said transporting direction and which is disposed between said guide member and said recording unit;

a warping part for warping said recording medium formed on said guide member; and supporting parts formed on said guide member, said supporting parts supporting both side edges of said recording medium warped by said warping part, wherein said guide member is ascendingly inclined with respect to said transport path section, and wherein said guide member directs said recording medium downward as said recording medium is transported in said transporting direction.

11. A recording apparatus according to claim 10, wherein said warping part includes an included recording medium transporting surface for changing the transporting direction of said recording medium to thereby warp said recording medium, and said supporting parts have support surfaces which are flush with said recording medium transporting surface.

12. A recording apparatus according to claim 11, wherein an auxiliary supporting part for supporting both side edges of said recording medium is provided on said recording medium transporting surface.

13. A recording apparatus according to claim 10, wherein a plurality of said supporting parts are arranged such that a length of the arrangement of said supporting parts is narrower than each of said recording medium of the different widths.

14. A recording apparatus comprising:

a feeding unit for storing and feeding a recording medium;

a recording unit for recording information on said record medium being fed from said feeding unit;

a discharging unit discharging said recording medium transported through said recording unit;

a guide member forming a sheet transporting surface disposed on a downstream side of said recording unit in a transporting direction of said recording medium;

a transport path section which transports said recording medium in said transporting direction and which is disposed between said guide member and said recording unit;

a warping part formed on at least one of said guide member and said transport path section forwarding said recording medium; and a discharge roller provided downstream of a warped portion of said recording medium, wherein said guide member is inclined with respect to said transport path section, wherein said guide member directs said recording medium downward as said recording medium is transported in said transporting direction, wherein said warping part includes a first sheet transporting surface ascendingly, inclined and a second sheet transporting surface descendingly inclined with respect to the sheet transporting path of said recording medium.

15. A recording apparatus comprising:

a feeding unit for storing and feeding recording medium;

a recording unit for recording information on said recording medium fed from said feeding unit;

a discharging unit for discharging outside said recording medium transported through said recording unit;

a guide member forming a sheet transporting surface disposed on a downstream side of said recording unit in a transporting direction of said recording medium;

a transport path section which transports said recording medium in said transporting direction and which is disposed between said guide member and said recording unit, wherein said guide member is inclined with respect to said transport path section, wherein said guide member directs said recording medium downward as said recording medium is transported in said transporting direction, a warping part for warping said recording medium formed on said guide member, said warping part having a first sheet transporting surface ascendingly inclined and a second sheet transporting surface descendingly inclined with respect to the transporting direction of said transporting medium; and supporting parts formed on said guide member, said supporting parts supporting both side edges of said recording medium warped by said warping part.

16. A recording apparatus according to claim 15, wherein said supporting parts have support surfaces which are flush with said first ascendingly inclined sheet transporting surface.

17. A recording apparatus according to claim 16, wherein a plurality of said supporting parts are arranged such that a length of the arrangement of said supporting parts is narrower than each of said recording medium of different widths.

18. A recording apparatus according to claim 15, wherein auxiliary supporting parts for supporting both side edges of said recording medium are provided on said first ascendingly inclined sheet transporting surface of said of warping part.

19. A recording apparatus according to claim 15, wherein an inclination angle of said first ascendingly inclined sheet transporting surface of said warping part is around 6°.

* * * * *